US005249765A

United States Patent [19]

Garcia

[11] Patent Number: 5,249,765

[45] Date of Patent: Oct. 5, 1993

[54] PICTURE HANGING APPARATUS

[76] Inventor: Emmett E. Garcia, 410 W. Orango Pl., Tucson, Ariz. 85737

[21] Appl. No.: 773,358

[22] Filed: Oct. 8, 1991

[51] Int. Cl.[5] ..... A47G 1/16

[52] U.S. Cl. ..... 248/475.1; 248/497

[58] Field of Search ..... 248/475.1, 476, 489, 248/495, 497, 498

[56] References Cited

U.S. PATENT DOCUMENTS

| | | | |
|---|---|---|---|
| 1,887,159 | 11/1932 | Knight | 248/489 |
| 2,075,588 | 3/1937 | Meyers | 248/489 X |
| 2,126,630 | 8/1938 | Gleitsman | 248/498 X |
| 2,588,009 | 3/1952 | Jones . | |
| 2,709,056 | 5/1955 | Jacquet . | |
| 3,261,578 | 7/1966 | Himebaugh . | |
| 3,861,639 | 1/1975 | Morrill . | |
| 4,315,615 | 2/1982 | Scocozza | 248/475.1 X |
| 4,591,125 | 5/1986 | Bellehumeur . | |
| 4,689,906 | 9/1987 | Sherman | 248/495 X |
| 4,903,934 | 2/1990 | Fremstad . | |

FOREIGN PATENT DOCUMENTS

| | | | |
|---|---|---|---|
| 2400187 | 10/1974 | Fed. Rep. of Germany | 248/497 |
| 463167 | 4/1951 | Italy | 248/497 |
| 1384094 | 2/1975 | United Kingdom | 248/497 |
| 1534271 | 11/1978 | United Kingdom | 248/497 |
| 2225372A | 5/1990 | United Kingdom | 248/489 |

*Primary Examiner*—Karen J. Chotkowski
*Assistant Examiner*—Derek J. Berger
*Attorney, Agent, or Firm*—Schmeiser, Morelle & Watts

[57] ABSTRACT

The invention is a two-part picture hanging system in which one part is attached to the picture frame and the other part is secured to a vertical wall. The part that is attached to the picture includes a recess designed to inwardly receive a portion of the wall-mounted part of the system. In one embodiment of the invention, the part that is attached to the picture includes a shaped portion that is designed to fit within a complementary-shaped channel in the frame. Once in place, the part can be moved to any desired position along the channel and then locked in place. An embodiment of the wall-secured part of the system is taught in which the part is a standard cap screw having a hexagonally-shaped head. The complementary picture-secured part of the system includes a recess having flat sides and is designed to inwardly receive the cap of the screw with the flat sides of the recess securely contacting two flat sides of the cap. In each of the embodiments, the picture is prevented from shifting by flat portions of the wall-mounted part contacting flat portions of the picture-mounted part of the system.

2 Claims, 3 Drawing Sheets

FIG. 19
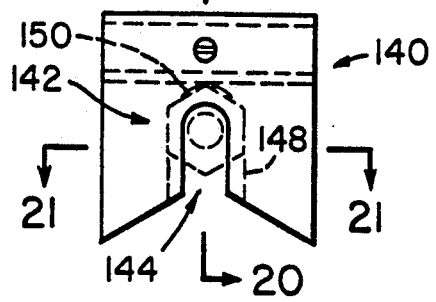
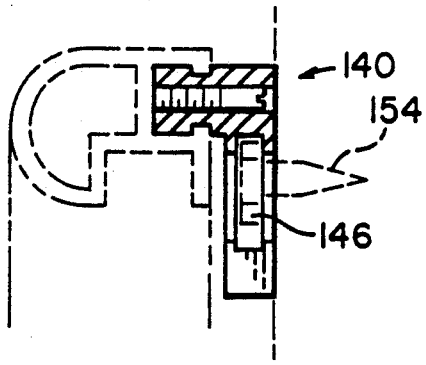
FIG. 20
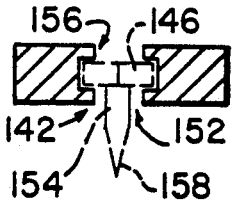
FIG. 21
FIG. 12
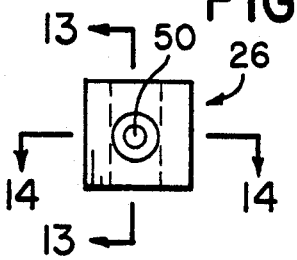
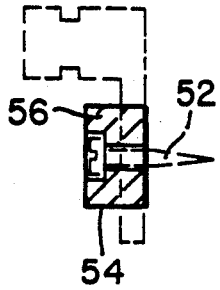
FIG. 13
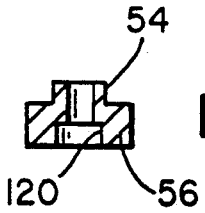
FIG. 14
FIG. 15
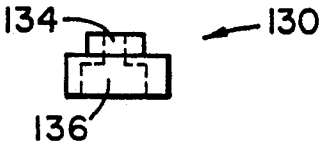
FIG. 16
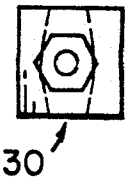
FIG. 17
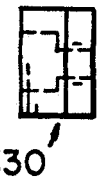
FIG. 18
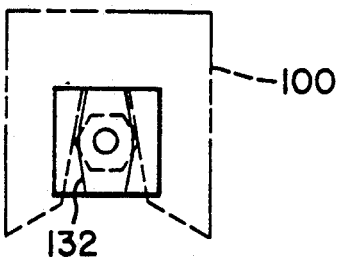

PICTURE HANGING APPARATUS

FIELD OF THE INVENTION

The invention is in the field of apparatus used for hanging a picture. More particularly, the invention is a two-part hanger system that enables a person to securely hang a picture on a vertical foundation in a minimum of time.

BACKGROUND OF THE INVENTION

Most people have experienced numerous difficulties when attempting to hang a picture with the apparatus normally used for this function. These difficulties start when the user initially tries to determine the correct location on the wall for the mounting nail. Once the picture has been secured to the wall, the person must attempt to obtain a correct alignment of the picture. After this is accomplished, the person may have to readjust the orientation of the picture almost daily due to vibrations or other disturbances that cause the picture to shift or rotate on the hanging apparatus.

The most common method for hanging a picture makes use of a nail that the user must first accurately secure to a vertical wall. Next, the user hangs the picture on the nail by catching a wire or bracket that extends across the rear surface of the picture onto the body of the nail. The first problem with this method is that it is extremely difficult for the user to accurately determine where to place the nail on the wall's surface to achieve the proper picture height. The user must account for the flexure of the wire (if used) and/or the spacing of the wire or bracket from the top or bottom edge of the picture. Once the securing nail has been inserted into the wall, the user will normally encounter a second problem. This occurs as the user tries to locate the nail as he or she is lowering the picture into place. This is due to the fact that the user cannot see the nail behind the picture at the time when he or she is holding the picture in front of the nail. After the picture has been hung, the user may realize that the height or orientation of the picture is incorrect. To correct this type of mistake, the user is required to completely repeat the hanging process without any guarantee that the second repetition will be more successful than the first.

Another problem that is often encountered with the apparatus normally used for hanging pictures is long term stability of the picture. Vibrations are often transmitted through the walls of the building from trucks, planes or other heavy vehicles or from minor local ground transmitted disturbances. These vibrations tend to cause the picture to shift or rotate on its securement apparatus. To correct the shifting, the user must manually adjust its orientation. In a city or other busy area, this can be a daily requirement.

To overcome the failings of the traditional picture hanging methods, a number of two-part hanging systems have been devised and patented. Jones (U.S. Pat. No. 2,588,009), Himebaugh (U.S. Pat. No. 3,261,578), Jacquet (U.S. Pat. No. 2,709,056) and Morrill (U.S. Pat. No. 3,861,639) all provide examples of these types of systems. Typically, a female portion is attached to the rear of the frame and a male portion is attached at an appropriate location to the wall. In U.S. Pat. No. 4,591,125 (issued to Bellehumeur), a variation on the two-part system is taught. Bellehumeur attaches the male portion of his system to the rear of the picture and the female portion is attached to the wall.

The prior art two-part systems provide numerous advantages over traditional picture hanging methods. Some of the devices allow some adjustability of the picture, others hold the picture to the wall in a more secure fashion. However, the prior art devices are complex, difficult to manufacture, expensive and complicated to use.

SUMMARY OF THE INVENTION

The invention is a two-part picture hanging system that comprises complementary male and female hanger portions. The female portion is attached to the rear of a top segment of the frame. The male portion is secured at an appropriate location on the wall. The user then hangs the picture by interconnecting the two portions. Once mated, the portions securely affix the picture to the wall and prevent the picture from moving due to vibrations or other minor disturbances.

There are a number of different embodiments of the invention. The primary difference between many of the embodiments is the shape of the male portion of the system. In all of the embodiments, the male portion is in the form of a member that has a "T"-shaped cross-section. Two different types of male portions are employed. The first type is a specially designed member that includes a central aperture through which a screw-type fastener can partially pass. The second type of male portion that can be used is in the form of a standard screw-type fastener that has a hexagonal head.

The female portion of the system comprises a member that includes two sections. The first section is adapted for ready attachment to a frame and includes either fastener receiving apertures or a special shape that allows it to be slidingly engaged within a channel of the frame. The second section of the female portion of the system is adapted to internally receive the male portion of the system. The shape of the second section facilitates the entry and secure engagement of the male portion. To achieve this result, a shaped lower portion of the member leads to a vertically extending slot or recess that includes flat vertically oriented sidewalls.

The first objective of the invention is to provide a picture hanging system that facilitates the hanging of a picture in any desired location. The system allows the user to easily determine where the picture will be located once it is secured by the system. This avoids the frustrations associated with prior art fastening systems in which the picture's final position cannot be easily determined until after the hanging apparatus is installed in the wall.

The second objective of the invention is to provide a picture hanging system that allows the quick engagement or disengagement of the picture from the wall portion of the system.

The third objective of the invention is to provide a picture hanging system that can be quickly and easily installed.

The fourth objective of the invention is to provide a picture hanging system that can securely hold a picture to a wall and will not allow the picture to shift due to vibrations or other minor disturbances.

BRIEF DESCRIPTION OF THE DRAWINGS

FIG. 12 is a detailed front view of the embodiment of the male portion of the hanging system that was shown in FIG. 1.

FIG. 13 is a side view of the male portion shown in FIG. 12 with a female portion of the system shown in phantom.

FIG. 14 is a top view of the male portion shown in FIG. 12.

FIG. 15 is a top view of a second embodiment of the male portion of the hanging system.

FIG. 16 is a rear view of the male portion of the system shown in FIG. 15.

FIG. 17 is a side view of the embodiment shown in FIG. 15.

FIG. 18 is a front view of the embodiment shown in FIG. 15 with a female portion of the system shown in phantom.

FIG. 19 is a front view of an eighth embodiment of the female portion of the system shown attached to a third embodiment of the male portion of the hanging system.

FIG. 20 is a side view of the embodiments of the hanging system shown in FIG. 19 with a picture frame shown in phantom.

FIG. 21 is a bottom view in the area of the connection between the male and female portions of the hanging system shown in FIG. 19.

DETAILED DESCRIPTION OF THE DRAWINGS

Figure 2:
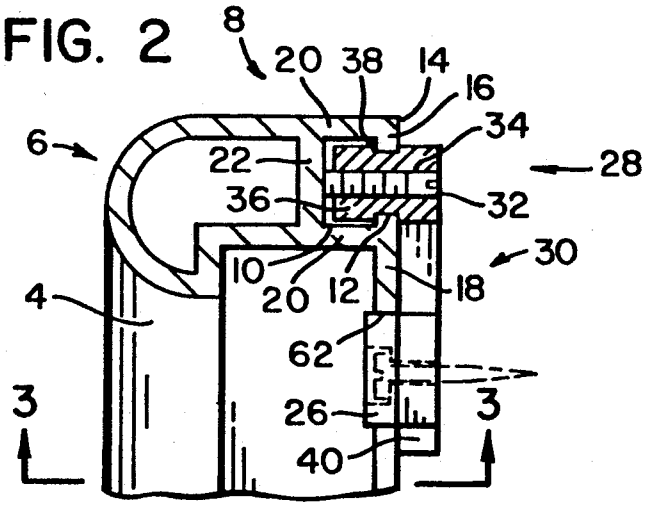
FIG. 2 is a cross-sectional perspective view taken in the area of the fastener system shown in FIG. 1.

Referring now to the drawings in greater detail, wherein like reference characters refer to like parts throughout the several figures, there is shown by the numeral 1 a picture mounted on a wall using a hanging system in accordance with the invention.

The picture 2 comprises an extruded frame having four segments 4 that comprise the frame's top, bottom, right and left sides. The frame is shown in detail in FIG. 2 and is normally fabricated from a metal or plastic material. The frame includes a forward section 6 that is visible to the viewer when the picture is in place on a wall. The rear section 8 of the frame includes a hollow channel 10 that has a slot-like opening 12 in the rear face 14 of the frame. Both the channel and its associated opening extend longitudinally along the length of each side or segment of the frame. Above and below the opening are walls 16 and 18 respectively. The walls 16 and 18 of the opening extend inwardly from the top and bottom sides 20 of the channel. The channel includes a rear wall 22 that extends longitudinally for the length of the channel. Therefore, the channel's rear wall, sides and front walls define a hollow internal area that has a "T"-shaped vertical cross-section and that extends the length of each side/segment of the frame.

The picture hanging system of the invention includes a female member/portion 24 that is designed to be attached to the picture and a male member/portion 26 that is adapted to be fastened to the wall.

Figure 3:
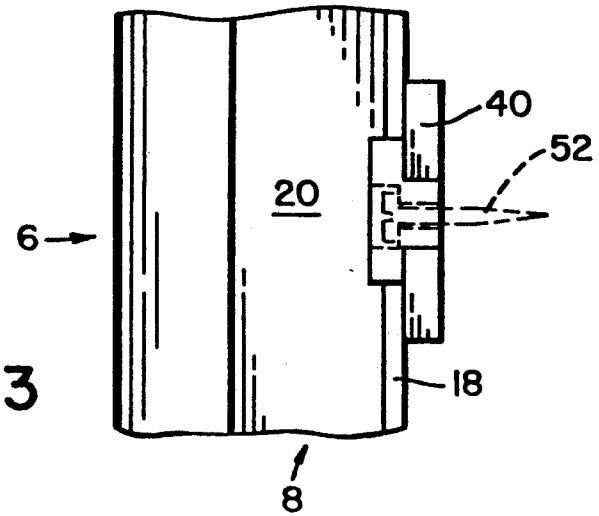
FIG. 3 is a bottom view of a top portion of the picture shown in FIG. 1.
Figure 1:
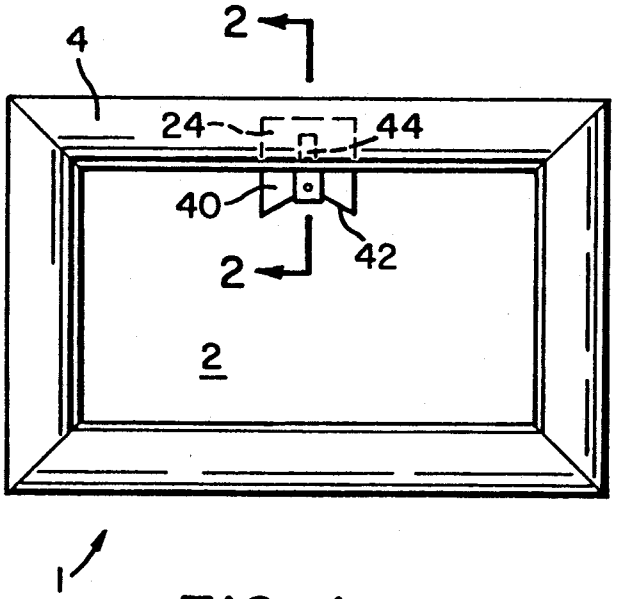
FIG. 1 provides a front view of a picture installed on a wall using a hanging system in accordance with the invention.

The female portion of the system is shown in FIGS. 1-3 and includes a first portion 28 that connects to the picture frame and a second portion 30 that is adapted to receive the male portion of the hanging system.

The first portion 28 of the female member has a "T"-shaped cross-section (shown in FIG. 2) that matches the "T"-shape of the interior of the frame channel 10. When the frame is initially being assembled, portion 28 of the female member is inserted into the channel of the top segment of the frame. Portion 28 is sized so that there is only a slight clearance between the interior surfaces of the channel and the exterior surface of the first portion of the female member. This enables the user to slide the female member along the length of the channel with the channel acting as a track.

To prevent unwanted relative movement between the frame and the female member, a lock screw 32 may optionally be used. The lock screw is designed to fit within a threaded bore 34 in the female member and to have a length so that it can extend outwardly from the rear face 36 of the female member and contact the rear wall 22 of the channel. By tightening the screw, the screw pushes on the rear wall of the channel and causes the front surfaces 38 of the female member to lockably contact the interior surfaces of the channel walls 16 and 18. This causes the female member to become locked into a fixed position within the channel. If the user wishes to move the female member in the channel, he or she loosens the lock screw and is then able to slide the female member to a new location along the length of the frame segment. This allows a horizontal adjustability of the picture when it is being attached to a wall.

The second portion 30 of the female member includes two downwardly extending fingers 40. Each finger has a bottom edge 42 that extends diagonally upwards toward a slot-like opening 44 located between the two fingers. In the embodiment shown in FIGS. 1-3, the fingers extend downwardly past the bottom wall 18 of the frame segment.

The male portion 26 of the system that is shown in FIGS. 1-3 is detailed in FIGS. 12-14. The member is "T"-shaped in cross-section and is preferably fabricated from a plastic material. The member includes a through bore 50 through which a fastener 52 such as a screw can partially pass. The fastener functions to secure the member to a wall. When the member is secured to a wall, the base 54 of the "T" will be in contact with the wall surface and the arms 56 of the "T" will be spaced from the wall by a predetermined distance. This spacing allows the fingers 40 of the female portion to be captured between the arms of the male member and the wall's surface. When placed in this manner, the base 54 of the male member will be received within the slot 44 of the female member. The base 54 of the male member fits within the slot and the top surface of portion 56 contacts the bottom edge 62 of the frame segment.

Figure 4:
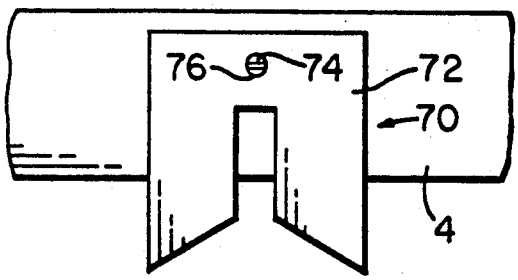
FIG. 4 is a rear view of a top portion of a picture showing a second embodiment of the female portion of the hanging apparatus.
Figure 5:
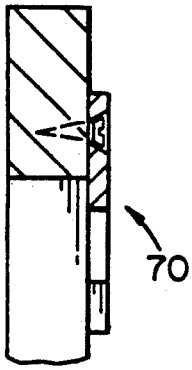
FIG. 5 is a side view of the embodiment shown in FIG. 4.

FIGS. 4 and 5 show a second embodiment of a female portion 70 of the hanging system. This embodiment is meant to be attached to a wooden or other type of frame that does not include a rear channel. The member consists of a flat plate that includes a top part 72 that is designed to be attached to the frame by a screw 74 that partially fits through an aperture 76.

Figure 6:
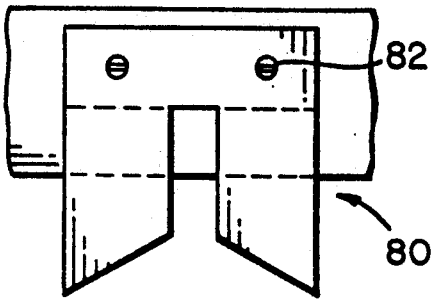
FIG. 6 is a rear view of a top portion of a picture showing a third embodiment of the female portion of the hanging apparatus.
Figure 7:
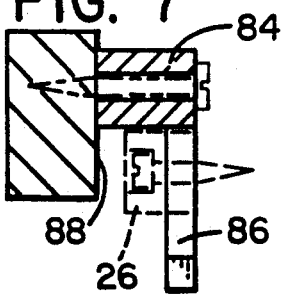
FIG. 7 is a side view of the embodiment of the invention shown in FIG. 6 with a male portion of the hanging system shown in phantom.

FIGS. 6 and 7 show a third embodiment of a female member 80 of the system. The embodiment shown includes a top part that is adapated for attachment to a frame that does not include a channel. The female member preferably includes two apertures 82 through which screws may partially pass to anchor the female member to the frame. As can be seen in FIG. 6, this embodiment of the female member includes an elongated upper portion 84 that causes the downwardly extending fingers 86 to be spaced from the rear surface 88 of the frame. This causes the wide part of the male portion 26 of the system to be sandwiched between the fingers of the female member and the rear surface of the frame. In this arrangement, the flat upper surface of the male member contacts a flat bottom surface of portion 84 of the female member. It should also be noted that the top of the slot in the female member is defined by a flat surface. The flat upper surface of the male portion can contact the flat surface of the female portion either in the area above the wide part of the male member, above the narrow part of the male member (at the top of the slot) or in both areas.

Figure 8:
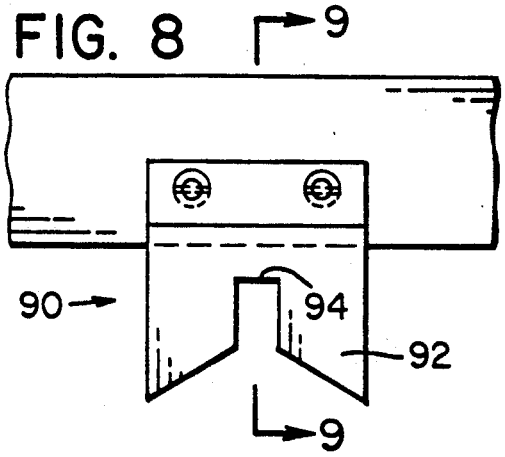
FIG. 8 is a rear view of a top portion of a picture showing a fourth embodiment of the female portion of the hanging apparatus.
Figure 9:
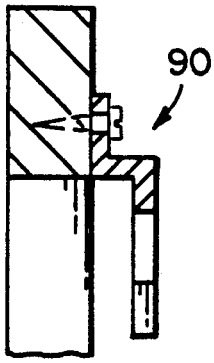
FIG. 9 is a side view of the female portion of the hanging system shown in FIG. 8.

FIGS. 8 and 9 show a fourth embodiment of a female member 90 of the hanging system. In this embodiment, a thin "L"-shaped top portion of the female member is secured to a frame segment using screws. The "L" shape allows the fingers 92 to be spaced from the rear of the frame.

It should also be noted that the female member of the system can be secured in a number of vertical locations along the vertical length of the frame segment. In the location shown in FIG. 7, the male member of the system is captured between the fingers 92 of the female member and does not abut the surface of the frame. In this arrangement, the top surface of the male member 26 would abut the flat top surface 94 of the slot.

Figure 10:
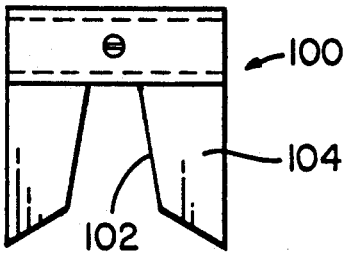
FIG. 10 is a rear view of a fifth embodiment of the female portion of the system.

In FIG. 10, a fifth embodiment of the female portion 100 of the system is shown. In this embodiment, the edges 102 that define the slot between the fingers 104 are at an angle from the vertical. In this embodiment, a male member having a complementary-shaped base portion would be used (note FIGS. 15–18).

Figure 11:
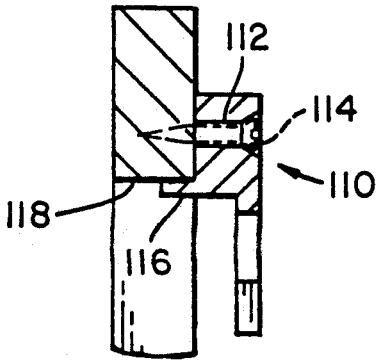
FIG. 11 is a side view of a sixth embodiment of the female portion of the hanging system shown attached to an upper segment of a frame.

FIG. 11 shows a sixth embodiment of a female member 110 of the system. In this embodiment, the shape of the top portion of the female member that attaches to the frame should be noted. The portion includes one or more apertures 112 through which one or more fastening screws 114 can partially pass. In addition, the top portion of the female member includes a lower shoulder 116 that is designed to contact the bottom surface 118 of the frame. The shoulder facilitates the anchoring of the female member and tends to take some of the weight of the picture off the anchoring screw(s) 114 once the picture is hung.

FIGS. 12 through 14 provide a detailed view of a first embodiment of the male member/portion 26 of the system. The male member has a "T"-shaped cross section and includes a head or cap portion 56 and a base portion 54. A through-bore 50 extends through both portions and is sized to receive the body of a screw-type fastener. The head portion 56 includes an oversized bore 120 for inwardly receiving the head of a screw-type fastener (note FIG. 1). The base portion 54 has flat sides that are spaced from each other by a distance that is approximately equal to or slightly less than the distance between the inner edges of the complementary slot 44 of the female member. In this manner, when the male member is in place within the female member, the sides of the base portion 54 of the male member will firmly contact the interior edges of the slot of the female member.

The outer sides of the head of the male member are flat and perpendicular to each other. When the male member is secured to the wall, it is oriented so that two sides of the head are vertical and the other two sides are horizontal. In this manner, when the male member is within the female member, the top horizontal side of the head may securely contact a flat horizontal surface of either the frame or of the female member. Alternatively, the flat upper surface of the base portion 54 can contact the horizontal top edge of the slot. In this manner, a secure contact is made which prevents the picture from shifting once it has been hung.

FIGS. 15–18 show a second embodiment of the male member 130 of the system. In this embodiment, the sidewalls 132 of the body of the male member are angled. This embodiment would be used with the embodiment of the female member shown in FIG. 10. The use of angled complementary contact portions in the male and female portions of the system provide a self centering connection in which the weight of the picture is distributed to the top and sides of the male portion of the hanging system. The member includes a through-bore 134 for the partial receipt of a screw-type fastener (not shown). A hexagonally-shaped outer bore 136 is shown for the receipt of a hexagonally-shaped cap/-head of the fastener. The outer bore can alternately have a circular bore for the receipt of a round-headed fastener as shown in use with the first embodiment of the male member 26.

FIGS. 19 through 21 show a seventh embodiment of the female member 140 and a third embodiment of a male portion 142 of the system. In these figures, the female member includes a vertically-extending recess 144 that is designed to tightly receive the cap 146 of the male member. The recess 144 includes flat vertical sidewalls 148 and an arcuate top portion 150. The recess also includes a slot 152 in its rear face through which the body 154 of the male portion can pass. An optional front slot 156 is also shown. The male portion 142 of the system shown in FIGS. 19–21 is a standard-type fastener having a hexagonally-shaped cap 146. The body 154 of the fastener has an exterior screw thread and ends at a point 158. When the cap of the male member is in place within the recess 144, two opposite flat sides of the cap firmly contact the flat interior vertical sides of the recess and thereby prevent any relative motion between the two members.

The basic operation of the system is as follows:

The user first attaches the female portion of the system to the rear of the upper segment of the picture frame. Next, the user determines the location on the wall where he or she wants the picture. The picture is placed in the desired location and a mark is placed on the wall just above the top edge of the picture proximate its midpoint. The picture is then removed.

The user then measures a predetermined distance downwardly on the wall and makes another mark. At this location, the male portion of the system is attached to the wall using one or more screws or nails.

The picture is again placed slightly above the desired position and then it is moved downwardly until the female portion of the system captures the male portion. This is accomplished when the body of the male portion is within the slot (for the first two embodiments of the male portion) or when the cap of the male portion is within the recess (for the third embodiment of the male portion). The downward travel of the picture is stopped when the top surface of the male portion contacts a bottom surface of either the female portion or the frame segment.

When the system is employed with picture frames having a hollow rear channel, some horizontal adjustability of the picture is possible. This is achieved by sliding the female member of the system within the channel to any desired location and then locking it in position using the lockscrew(s).

It should be noted that the design of the system allows the picture to be hung from other than a midpoint of the top frame segment without the weight of the picture causing the picture to rotate on the hanging system.

It should also be noted that while the use of only one set of male and female portions of the system are shown for hanging a picture, multiple sets may be used. This is especially needed when unusually heavy or long pictures are to be secured. In most cases, two sets of securing members are sufficient with each set located near a top corner of the picture. In this situation, the ability to slide the female member within a channel of the frame greatly simplifies and speeds up the hanging procedure.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. In combination, a picture hanging system and a picture frame comprising:

a picture frame having a top segment, a bottom segment and two side segments, said top segment having a front surface, a planar, vertically-oriented rear surface and a planar, horizontally-oriented bottom surface;

a first member adapted for attachment to the rear surface of the top segment of the picture frame, said first member being a flat plate that, when attached to the picture frame, forms a vertically-oriented planar surface parallel to and adjacent the rear surface of the top segment of the picture frame, said first member having a vertically extending slot that has vertically extending sidewalls;

a second member having an aperture through which a fastener may partially pass to thereby secure the second member to a vertical foundation, said second member also having a head portion and a body portion wherein the second member has a "T"-shaped horizontal cross-section with the head portion forming one portion of the "T" and the body portion forming a perpendicular second portion of the "T" and wherein when the first and second members are joined, the body portion of the second member fits within the slot of the first member and the head portion of the second member is located below and forwardly of the rear surface of the top segment of the picture frame; and wherein the body portion of the second member includes at least two flat sides and a flat top surface and wherein the slot in the first member is sized and shaped so that when the first and second members are joined, the two flat sides of the body portion contact along their length the flat sidewalls of the slot and the flat top surface of the body portion contacts a flat, horizontally-oriented surface that forms the top of the slot.

2. In combination, a picture hanging system and a picture frame comprising:

a picture frame having a top segment, a bottom segment and two side segments, said top segment having a front surface, a planar, vertically-oriented rear surface and a planar, horizontally-oriented bottom surface;

a first member adapted for attachment to the rear surface of the top segment of the picture frame, said first member being a flat plate that, when attached to the picture frame, forms a vertically-oriented planar surface parallel to and adjacent the rear surface of the top segment of the picture frame, said first member having a vertically extending slot that has vertically extending sidewalls;

a second member having an aperture through which a fastener may partially pass to thereby secure the second member to a vertical foundation, said second member also having a head portion and a body portion wherein the second member has a "T"-shaped horizontal cross-section with the head portion forming one portion of the "T" and the body portion forming a perpendicular second portion of the "T" and wherein when the first and second members are joined, the body portion of the second member fits within the slot of the first member and the head portion of the second member is located below and forwardly of the rear surface of the top segment of the picture frame; and wherein the head portion of the second member has a flat top surface wherein when the second member is joined to the first member, the top surface of the head portion of the second member contacts the planar bottom surface of the top segment of the picture frame.

* * * * *